US007163262B2

(12) United States Patent
Anglin

(10) Patent No.: US 7,163,262 B2
(45) Date of Patent: Jan. 16, 2007

(54) COOLER SEAT

(75) Inventor: John Anglin, San Marcos, CA (US)

(73) Assignee: Cool Seat LLC, Gainesville, FL (US)

( * ) Notice: Subject to any disclaimer, the term of this patent is extended or adjusted under 35 U.S.C. 154(b) by 200 days.

(21) Appl. No.: 10/672,802

(22) Filed: Sep. 26, 2003

(65) Prior Publication Data

US 2005/0067864 A1 Mar. 31, 2005

(51) Int. Cl.
*A47C 15/00* (2006.01)

(52) U.S. Cl. ..... 297/217.1; 62/331; 62/457.7; 297/184.15

(58) Field of Classification Search ..... 297/17, 297/217.1, 184.1, 184.15; 62/258, 326, 331, 62/457.1, 457.7
See application file for complete search history.

(56) References Cited

U.S. PATENT DOCUMENTS 1,256,902 A * 2/1918 Howe ..... 297/58
4,652,048 A * 3/1987 Nazar ..... 297/188.13
4,930,838 A * 6/1990 Brabant ..... 297/184.14
5,100,198 A * 3/1992 Baltzell ..... 312/235.2
5,240,020 A * 8/1993 Byers ..... 297/184.15
5,269,157 A * 12/1993 Ciminelli et al. ..... 297/217.1
5,299,337 A * 4/1994 Venza ..... 297/184.15
D369,695 S * 5/1996 Imotani ..... D6/397
6,241,313 B1 * 6/2001 Lenz et al. ..... 297/217.1
6,932,427 B1 * 8/2005 Tamura ..... 297/217.1

* cited by examiner

*Primary Examiner*—Peter R. Brown
(74) *Attorney, Agent, or Firm*—Rothwell, Figg, Ernst & Manbeck

(57) ABSTRACT

A Cooler Seat is disclosed. The seat has a seat back assembly and seat bottom assembly that provide comfortable seating and are collapsibly attached to a cooler container. The seat further includes a retractable awning for sun and rain protection. The seat bottom assembly further includes retractable footrests and clips for attaching to the tailgate of the conventional pickup truck. The seat is also configured to unfold and fit in the open end of a conventional pickup truck bed.

17 Claims, 5 Drawing Sheets

COOLER SEAT

BACKGROUND OF THE INVENTION

1. Field of the Invention

This invention relates generally to tamper-proof seals for containers and, more specifically, to a Cooler Seat.

2. Description of Related Art

Several seating assemblies for the tailgates of pickup trucks have been available in the past. One such device is the "Pick-up Truck Tailgate Seating and Entertainment System" of Reitzloff et al., U.S. Pat. No. 5,215,346. The Reitzloff system is a folding seatback that is mountable at the tailgate opening of a pickup bed. There is a cooperating series of seat cushions and drink holders mounted to the top surface of the tail gate itself, such that when the tailgate is lowered, a cushioned seat bottom is formed by the tailgate with the seatback being the Reitzloff device. The device further has a sound entertainment system built into it as well as an umbrella stand for attaching a sun shade thereto.

Another related device is the "Multi-functional Tailgate For Truck-like Vehicles" of Everett, U.S. Pat. No. 6,364,391. The Everett device is a "tailgate assembly" which consists of a pair of foldable seats that attaches or is incorporated into the tailgate of the pickup truck. The Everett foldable seats collapse into a flat condensed package and have a drink rest in between the pair. Each or both of the seats is exchangeable with a "table module," which is a folding table.

Munguia, U.S. Pat. No. 5,000,504 and Edwards, U.S. Pat. No. 6,116,676 both disclose tailgate-mountable seating assemblies. The Munguia device has seats that actually swivel. The Edwards device is attachable to the tailgate of the pickup truck only through the use of a pair of "attachment projections" that permits the seats to be easily attached to and detached from a truck bed.

None of these prior truck bed seats discloses a device that truly meets all of the needs of the traveling sportsman. In particular, they fail to address the need for refrigerated storage. Furthermore, there is only limited provision for protection from the sun and rain. Still further, the devices are fairly limited in their application—they are designed specifically for vehicle tailgates, and are not well suited for other applications.

There is a device that touts itself as a "Cooler and Seat System;" it is found in O'Quinn et al., U.S. Pat. No. 5,727,844. The O'Quinn device is essentially, a conventional cooler having a second lid atop the lid that encloses the cooler chamber. If the second lid is lifted, a seat is formed between the underside of the second lid and the top of the first (cooler-chamber-enclosing) lid. The O'Quinn device addresses the need for portable refrigeration and seating, but does not attach securely to a tailgate, nor does it provide any other utility for sportsmen.

What is needed is a seat assembly for attaching to the bed of a pickup truck that incorporates seating, refrigerated storage, protection from the sun and rain, as well as attachments and receptacles to aid the sportsman.

SUMMARY OF THE INVENTION

In light of the aforementioned problems associated with the prior devices, it is an object of the present invention to provide a Cooler Seat. The seat should have a seat back assembly and seat bottom assembly that provides comfortable seating and are collapsibly attached to a cooler container. The seat should further include a retractable awning for sun and rain protection. The seat bottom assembly should further include retractable footrests and clips for attaching to the tailgate of the conventional pickup truck. The seat should be configured to unfold and fit in the open end of a conventional pickup truck bed.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Cooler Seat.

Figure 1:
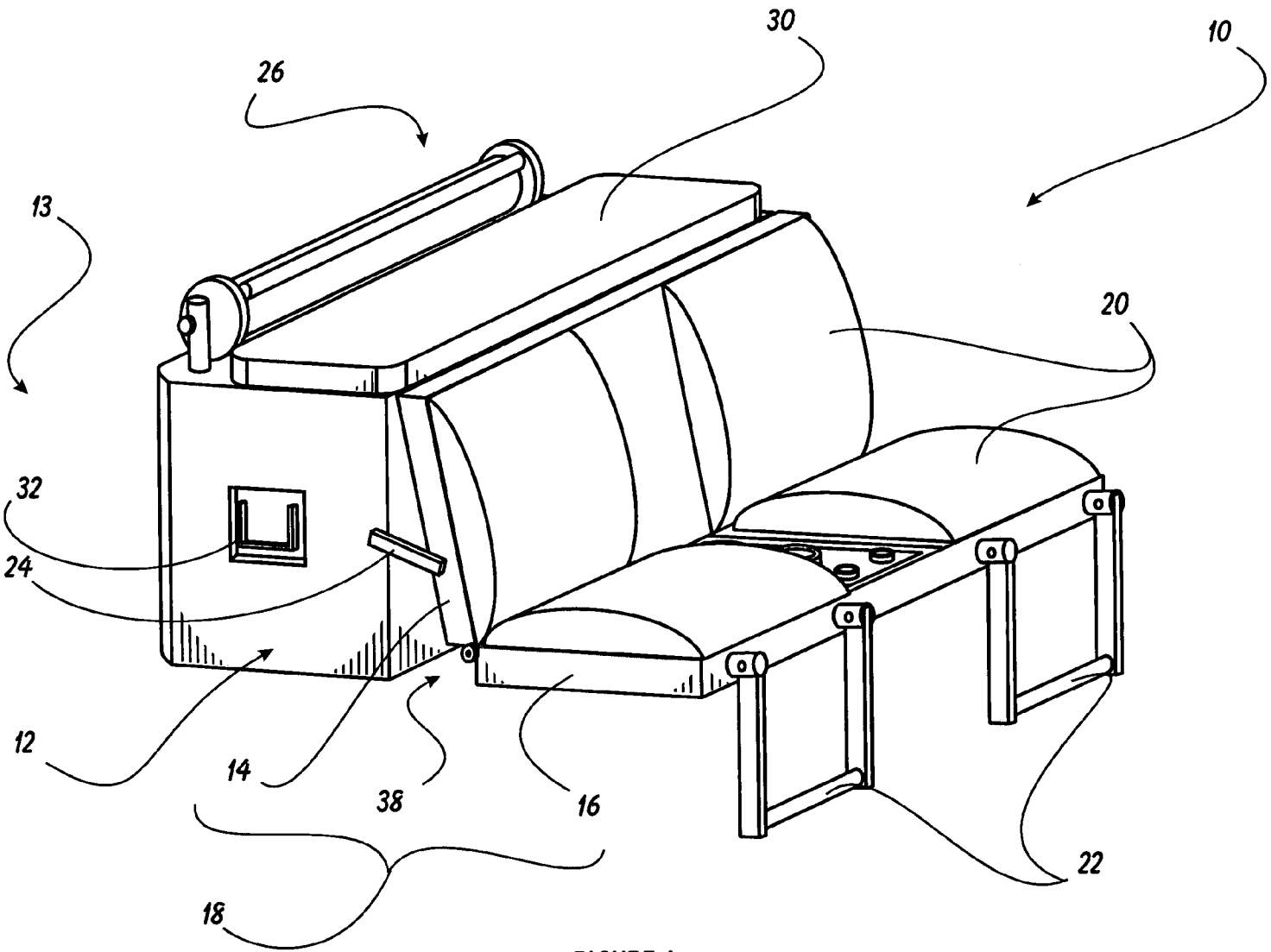
FIG. 1 perspective view of a preferred embodiment of the cooler seat of the present invention.

The present invention can best be understood by initial consideration of FIG. 1. FIG. 1 perspective view of a preferred embodiment of the cooler seat 10 of the present invention. The seat 10 is a portable assembly that comprises a cooler assembly 13 and a seat assembly 18. The cooler assembly 13 comprises, in part, a cooler container 12 having a lid 30 and a pair of handles 32 (one side depicted here). Shown here in its retracted position, is an awning 26. The awning 26 is formed from flexible material that is an effective sun screen; if desired, water-proof material might also be used. The cooler container 12 itself is constructed in well-known ways of prior coolers, such as from blow-molded plastic in order to provide a durable, insulated container.

The seat assembly 18 comprises two main subassemblies, the seat back assembly 14 and the seat bottom assembly 16. The seat back assembly 14 and seat bottom assembly 16 are attached to one another by a conventional means for permitting angular rotation between the two, such as the hinge 38 shown. The seat bottom assembly, more fully described below in connection with other drawing figures, has a pair of foot rests 22 retractably extending from its front face. The seat back assembly 14 also has a pair of removable cushions cooperatively aligned with those of the seat bottom assembly 16 in order to provide a pair of comfortable seats.

The seat assembly 13 is hingeably attached to the cooler assembly 13; the seat back assembly 14 can be reclined somewhat in order to provide a more comfortable seating position. Once pulled into the reclined position, the seat back assembly 14 is fixed in this position by a pair of struts 24 extending between the seat back assembly 14 and the cooler assembly 13. Now turning to FIG. 2, we can examine the invention in more detail.

Figure 2:
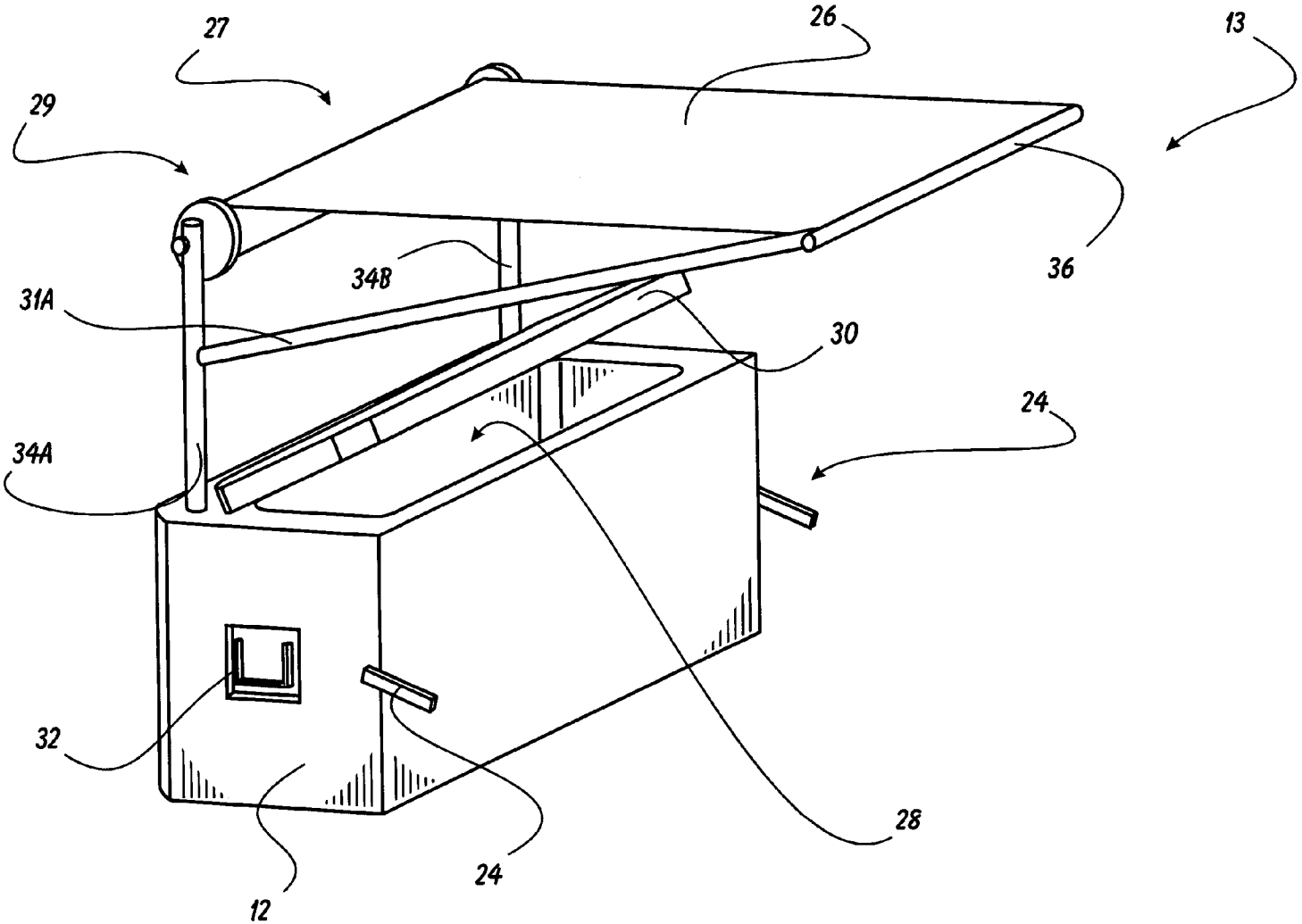
FIG. 2 is a perspective view of a preferred cooler assembly of the seat of FIG. 1.

FIG. 2 is a perspective view of a preferred cooler assembly 13 of the seat of FIG. 1. The assembly 13 comprises a cooler container 12, which is generally rectangular in shape in this embodiment, and defines an outer surface and an inner chamber 28. The walls of the cooler container 12 are insulated in order to provide superior storage for refrigerated beverages, food and other items. A lid 30 is hingeably or detachably attached to the cooler container 12 in order to enclose the chamber 28.

Behind the lid 30 is the awning assembly 27, which comprises an awning 26 made from sun- and/or water-resistant material. The awning 26 rolls onto and unrolls from a rotatable spool 29. The spool 29 spans between a pair of retractable posts 34A and 34B adjacent to each corner of the container 12. At the distal edge of the awning 26 is a edge rod 36 for keeping the awning flat and taut when it is extended. The edge rod 36 is held out in its position by a pair of side braces 31A and 31B (not shown). When transporting or storing the seat, the awning assembly 27 can be collapsed by folding the side braces 31, rolling the awning 26 onto the spool 29, and then retracting the posts 34 into the container 12. The result will position the spooled awning 26 flat against the top of the cooler container 12, adjacent to the lid 30.

Figure 3:
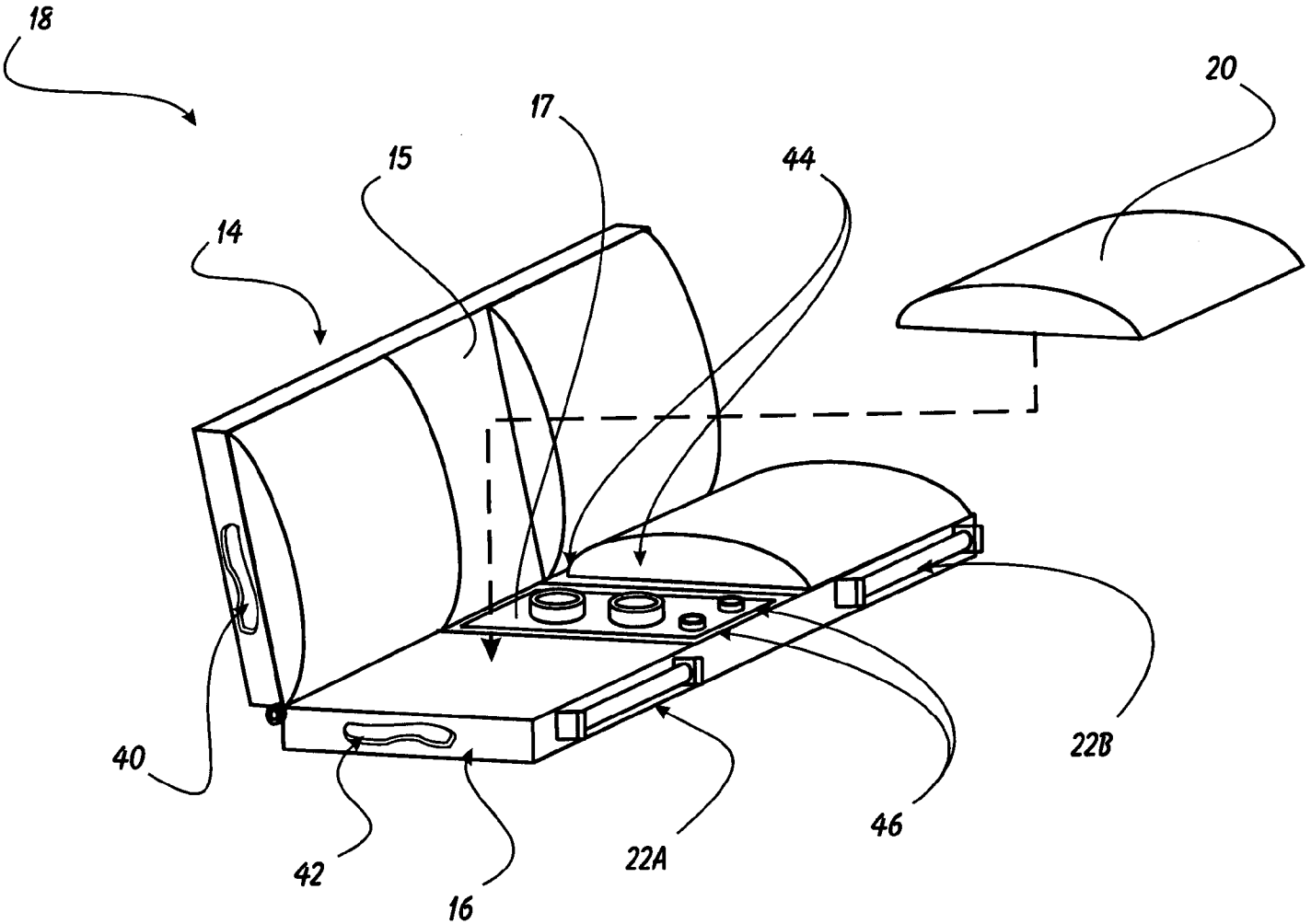
FIG. 3 is a perspective view of a preferred seat assembly of the cooler seat of FIG. 1.

Although not depicted here, the cooler container 12 further includes at least one drain to empty unwanted liquid from the cooler. Furthermore, in other embodiments, the awning assembly 27 may be replaced with a simple umbrella, the pole of which is placed into a suitable aperture formed in the seat bottom assembly (see FIG. 1). Turning to FIG. 3, we can now take a look at the seat assembly of the present invention.

FIG. 3 is a perspective view of a preferred seat assembly 18 of the cooler seat of FIG. 1. The seat assembly 18, as discussed above, has two sub-assemblies—the seat back assembly 14 and the seat bottom assembly 16. The seat back assembly 14 is defined by a back chamber 40, which is a container for storing additional (non-refrigerated) items, and a pair of removable cushions 20. The cushions 20 are attached to the lid 15 of the chamber 40; the chamber 40 is accessed by opening the lid 15. The seat back assembly 14 is attached to the seat bottom assembly 16 by a hinge 38 or other connecting apparatus that permits angular motion between the two assemblies 14 and 16.

The seat bottom assembly 16 is defined by a bottom chamber 42, provided for still more non-refrigerated item storage, and another pair of removable cushions 20; the cushions 20 are attachable to the lid 17 of the bottom chamber 42. When the cushions 20 are removed from either the seat back or seat bottom, the lids 15 and 17 can be used as tables or cutting boards. Also found in or extending from the seat bottom assembly 16 are a pair of drink receptacles 44 for holding beverage containers and preventing them from tipping. Adjacent to the drink receptacles 44 are two or more pole receptacles 46, which are essentially tubes recessed into the lid 17 of the bottom chamber 42. The pole receptacles 46 are each provided to hold the handle of a fishing pole; this permits the sportsman to recline comfortably while fishing without the need to hold onto the pole.

The seat bottom assembly 16 is further defined by a pair of foot rests 22A and 22B retractably extendable therefrom. In this view, the foot rests 22 are in their retracted position; when desired, the can be extended outwardly and downwardly from the seat bottom assembly 16 to provide a resting place for the sportsman's feet when the cooler seat is mounted to the tailgate of the truck or other vehicle. Additional details regarding the present invention can be examined by review of FIG. 4.

Figure 4:
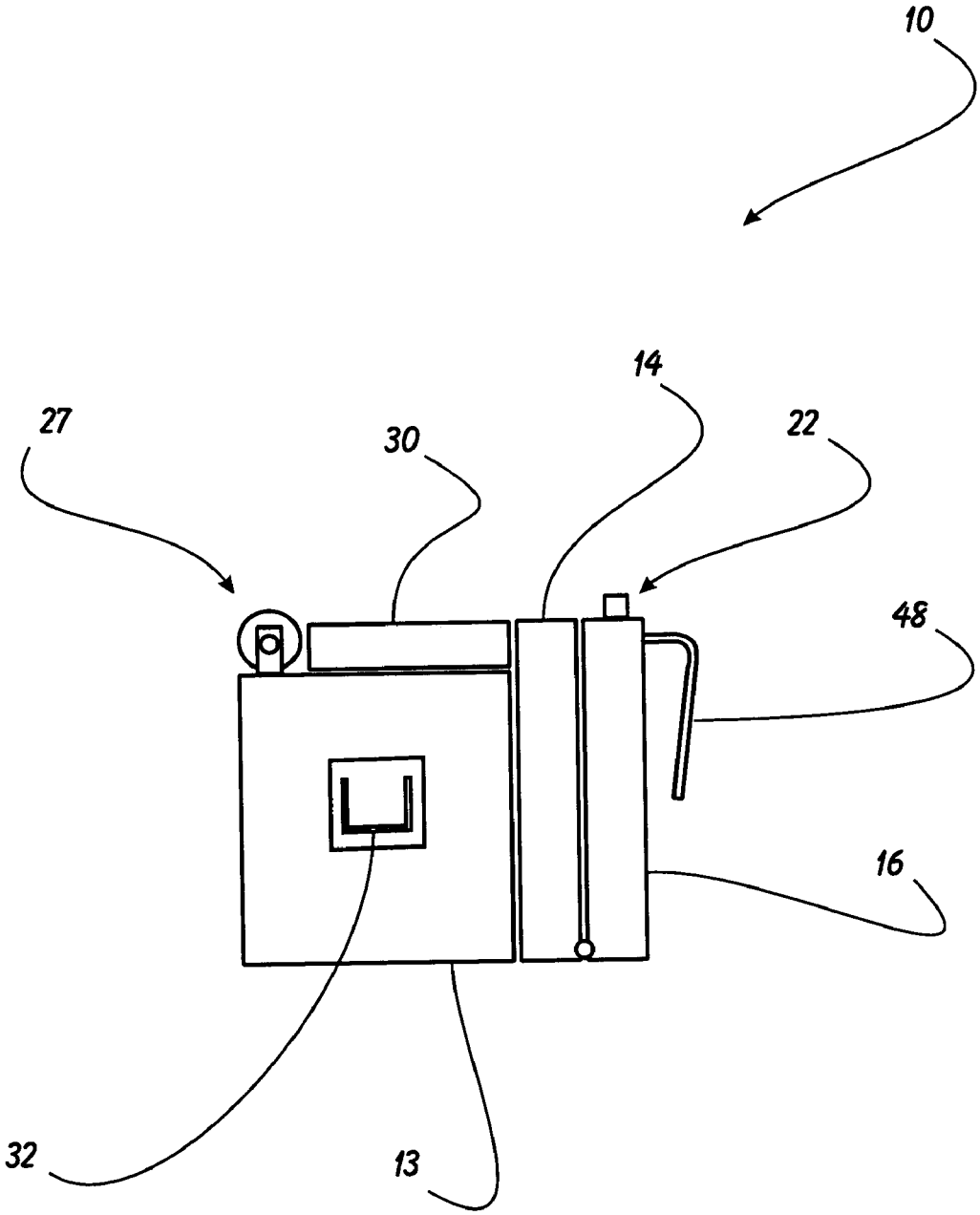
FIG. 4 is a side view of the cooler seat of FIGS. 1–3.

FIG. 4 is a side view of the cooler seat 10 of FIGS. 1–3. In this side view, the seat 10 has been folded into itself in order to provide the most consolidated, compacted package. The seat 10 is most easily transported to and from the vehicle when in this folded position. As shown, the seat bottom assembly 16 folds against the seat back assembly 14. The cushions (not shown) can be removed and placed into the bottom chamber and back chamber, if desired. The struts are removed so that the seat back assembly 14 can be folded flat against the front wall of the cooler assembly 13. Furthermore, the awning assembly has been placed in its retracted position, with the awning rolled up on the spool and the poles retracted into the cooler container. Since the lid 30 is not obstructed by the seating assemblies or the awning assembly 27, it provides easy access into the cooler container for the placement of removal of refrigerated products therein or therefrom.

Figure 5:
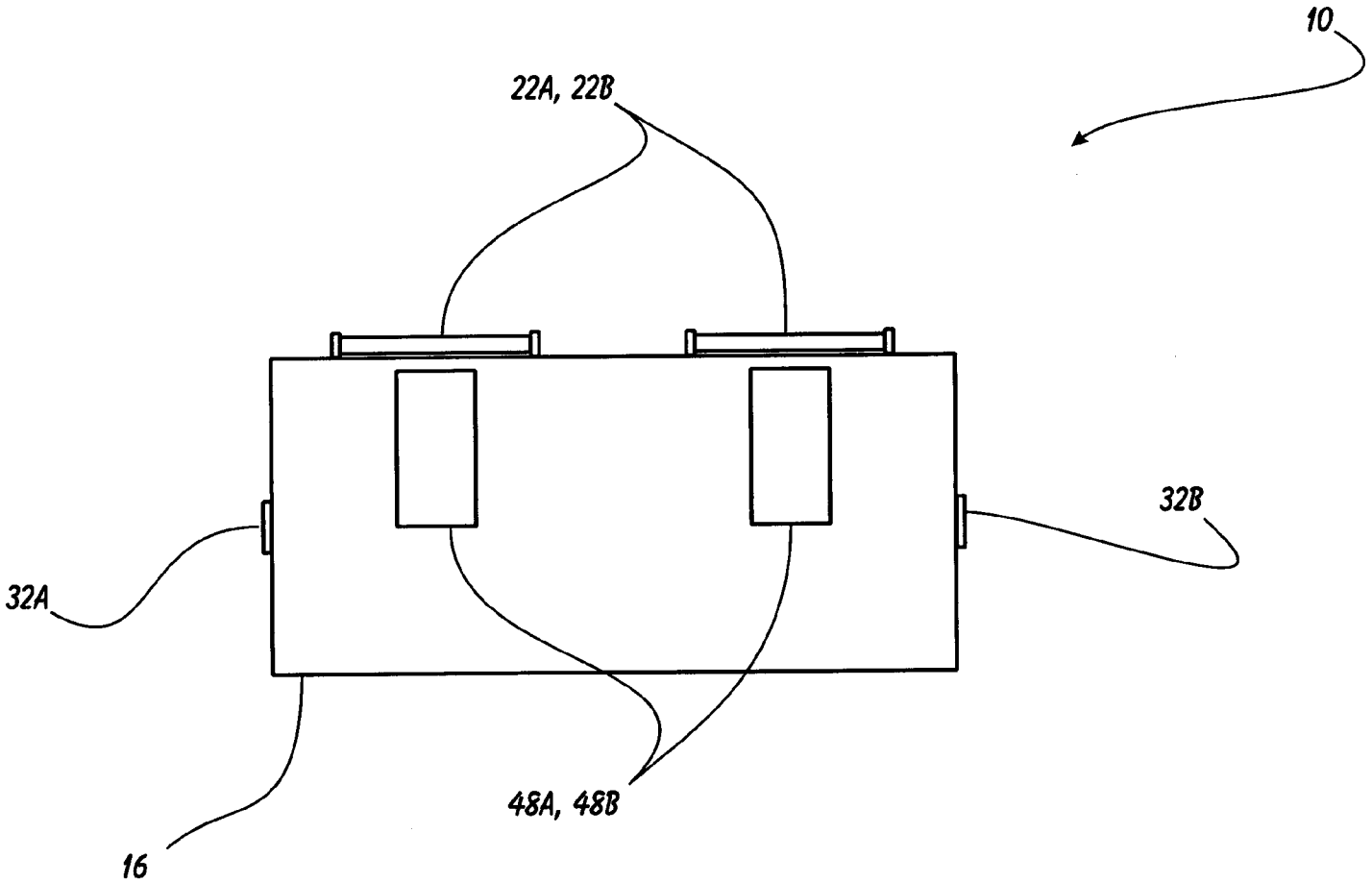
FIG. 5 is a front view of the cooler seat of FIGS. 1–4.

Another element depicted here is the tailgate clip 48. The tailgate clips 48 are durable arms extending from the bottom surface of the seat bottom assembly 16. The clips 48 are configured to slip over the end of a conventional pickup truck tailgate. When the tailgate is opened, and the seat 10 is placed in its open position (e.g. FIG. 1), the clips 48 can be slid over the end of the opened tailgate in order to retain the seat 10 in position when it is in use. The clips 48 comprise the following elements: a first portion extending from the bottom surface of the seat bottom assembly, a curved portion, and terminating in a substantially straight distal portion. FIG. 5 depicts these clips 48 from another perspective.

FIG. 5 is a front view of the cooler seat 10 of FIGS. 1–4. As shown, the is embodiment includes two tailgate clips 48A and 48B, dispersed evenly along the width of the seat bottom assembly 16; this will provide substantial stability when the clips 48 are engaged to a tailgate. In other versions, either fewer or more clips 48 might be employed, depending upon the particular design of the clips 48 themselves.

The clips 48 are preferably coated with a rubberized protective coating in order to prevent damage to the painted surface of the tailgate. Furthermore, the clips 48 or cooler seat may be provided with cables, hasps, or other structure to lock the cooler seat to the vehicle.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A cooler seat comprising:

a cooler assembly defined by front and rear walls and a pair of side walls;

a seat back assembly attached to said front wall, said seat back assembly comprising:

a back container defining a back chamber and a lid;

at least one cushion attached to said lid; and hinge means for attaching to said seat bottom assembly; and a seat bottom assembly attached to said seat back assembly.

2. The seat of claim 1, wherein said seat bottom assembly comprises:

a bottom container defining a bottom chamber and a lid;

at least one cushion removably attached to said lid; and at least one hinge means for attaching to said seat back assembly.

3. The seat of claim 2, wherein said cooler assembly further comprises:

a cooler container defining said front and rear walls and said pair of side walls;

a cooler chamber formed within said cooler container;

a lid closable over said cooler chamber; and an awning assembly extendable from said cooler container.

4. The seat of claim 2, further comprising a foot rest extendable from said bottom container.

5. The seat of claim 4, further comprising at least one drink receptacle formed in said bottom container lid.

6. The seat of claim 5, further comprising at least one pole receptacle formed in said bottom chamber lid.

7. The seat of claim 6, wherein said foot rest comprises:

a pair of rails in spaced relation, defined by inside ends and distal ends; end a crossbar interconnecting said rails adjacent to said distal end.

8. A combination cooler and seat comprising:

a cooler container defined by front and rear walls, a pair of side walls, and a top, an awning assembly comprising an awning attached to a spool, said spool attached to a pair of retractable posts; and a seat attached to said cooler container, said seat comprising a seat back hingably attached to said cooler container and a seat bottom hingably attached to said seat back, said seat defining a folded position wherein said seat back and said seat bottom are in juxtaposed position and an open position wherein said bottom is not juxtaposed over said back.

9. The combination of claim 8, wherein said cooler container further comprises:

a lid closable over said cooler chamber; and said awning assembly is extendable via at least one retractable post attached to said cooler container.

10. The combination of claim 9, wherein said seat comprises a seat back assembly hingably attached to a seat bottom assembly, said seat back assembly comprising:

a back container defining a back chamber and a lid;

at least one cushion removably attached to said lid; and hinge means for attaching to said seat bottom assembly.

11. The combination of claim 10, wherein said seat bottom assembly comprises:

a bottom container defining a bottom chamber and a lid; and at least one cushion removably attached to said lid.

12. The combination of claim 11, further comprising at least one tailgate clip extending from said seat bottom assembly.

13. The combination of claim 12, further comprising at least one drink receptacle formed in said bottom container lid.

14. The combination of claim 13, further comprising at pair of pole receptacles formed in said bottom chamber lid.

15. The combination of claim 14, further comprising a pair of foot rests in spaced relation and extendable from said bottom container.

16. The combination of claim 15, wherein each said foot rest comprises:

a pair of rails in spaced relation, defined by inside ends and distal ends; and a crossbar interconnecting said rails adjacent to said distal end.

17. A cooler seat, comprising:

a cooler assembly comprising a cooler container, and an awning assembly;

a seat back assembly hingably attached to said cooler assembly and movable between a folded position wherein a bottom edge of said seat back is adjacent to said cooler assembly and an opened position wherein said bottom edge is in spaced relation to said cooler assembly; and a seat bottom assembly hingably attached to said seat back assembly and movable between a folded position wherein said bottom is juxtaposed over said seat back assembly and an opened position wherein said seat back is not juxtaposed over said seat back assembly.

* * * * *